US010915071B2

(12) United States Patent
Oshita et al.

(10) Patent No.: US 10,915,071 B2
(45) Date of Patent: Feb. 9, 2021

(54) ELECTRONIC TIMEPIECE, DEVICE, METHOD AND COMPUTER-READABLE STORAGE DEVICE STORING INSTRUCTIONS FOR CONTROLLING METHOD FOR OBTAINING DATE/TIME INFORMATION

(71) Applicant: CASIO COMPUTER CO., LTD., Tokyo (JP)

(72) Inventors: Yuki Oshita, Tokyo (JP); Akihiro Kuroha, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 343 days.

(21) Appl. No.: 15/982,013

(22) Filed: May 17, 2018

(65) Prior Publication Data

US 2018/0335757 A1 Nov. 22, 2018

(30) Foreign Application Priority Data

May 17, 2017 (JP) ..... 2017-097832

(51) Int. Cl.
*G04R 20/02* (2013.01)
*G04R 20/04* (2013.01)
(Continued)

(52) U.S. Cl.
CPC ..... *G04R 20/04* (2013.01); *G04G 7/02* (2013.01); *G04R 20/02* (2013.01); *G04R 20/06* (2013.01)

(58) Field of Classification Search
CPC ..... G04R 20/04; G04R 20/06; G04R 20/02; G04G 7/02
See application file for complete search history.

(56) References Cited

U.S. PATENT DOCUMENTS 9,563,179 B2 * 2/2017 Matsue ..... G04R 20/06
2015/0168924 A1 * 6/2015 Kato ..... G04R 20/04 368/47

(Continued)

FOREIGN PATENT DOCUMENTS

CN 105739295 A 7/2016
JP 2015-172523 A 10/2015
JP 2016-121983 A 7/2016

OTHER PUBLICATIONS

First Office Action dated Feb. 6, 2020 received in Chinese Patent Application No. CN 201810469210.3 together with an English language translation.

(Continued)

*Primary Examiner* — Sean Kayes
(74) *Attorney, Agent, or Firm* — Scully Scott Murphy & Presser

(57) ABSTRACT

A device having: one or more processors for determining an elapsed time since a correction of a calculated date and time; estimate a degree of deviation included in the calculated date and time, based on the elapsed time; and in response to estimating the degree of deviation to be equal to or smaller than a predetermined range, execute a method by which the one or more processors: generate an expected code sequence of a code sequence to be received from a satellite; control a satellite radio wave receiver to receive the code sequence; determine whether there is a match between the expected code sequence and the code sequence; in response to determining that there is a match, obtain a present date and time information represented by the expected code sequence; and correct the calculated date and time, based on the present date and time information obtained.

18 Claims, 3 Drawing Sheets

(51) Int. Cl.
*G04G 7/00* (2006.01)
*G04R 20/06* (2013.01)

(56) References Cited

U.S. PATENT DOCUMENTS

| | | | | |
|---|---|---|---|---|
| 2015/0212495 | A1* | 7/2015 | Kato | G04R 20/04 368/47 |
| 2015/0253739 | A1* | 9/2015 | Iida | G04R 20/04 368/80 |
| 2016/0187858 | A1 | 6/2016 | Matsue et al. | |
| 2017/0176952 | A1* | 6/2017 | Misaki | G04G 9/0076 |

OTHER PUBLICATIONS

Extended European Search Report dated Oct. 9, 2018 received in European Patent Application No. EP 18172872.6.
Notice of Reasons for Refusal dated Mar. 31, 2020 received in Japanese Patent Application No. JP 2017-097832 together with an English language translation.

* cited by examiner

ELECTRONIC TIMEPIECE, DEVICE, METHOD AND COMPUTER-READABLE STORAGE DEVICE STORING INSTRUCTIONS FOR CONTROLLING METHOD FOR OBTAINING DATE/TIME INFORMATION

CROSS-REFERENCE TO RELATED APPLICATIONS

This application is based upon and claims the benefit of priority from Japanese Patent Application No. 2017-097832 filed on May 17, 2017 the entire contents of which are incorporated herein by reference.

BACKGROUND

1. Field of the Invention

The present invention relates to an electronic timepiece, a device, method and computer-readable storage device storing instructions for controlling method for obtaining date/time information.

2. Description of the Related Art

Conventionally, there is an electronic timepiece which receives present date/time information from external devices to accurately calculate the date and the time and which is able to maintain display. Standard time radio waves using radio waves at a low frequency band and navigation messages included in radio waves transmitted from a positioning satellite are widely used as external information sources which provide the present date/time information.

In such operation to receive radio waves, especially operation to receive radio waves from positioning satellites, a large amount of electric power is consumed compared to calculating the date and time or displaying the time on an electronic timepiece. Specifically, in a portable electronic timepiece, radio wave reception environment may drastically change when the user moves, and it is preferable that necessary information is received and obtained immediately.

Under such circumstances, there is a well-known technique which considers a deviation (rate) in the time measured in the electronic timepiece, estimates the amount of deviation in the present date and time based on the amount of time which elapsed after obtaining the present date/time information from external devices, and setting the necessary information within the estimated range as the target of reception in order to shorten the reception time as much as possible (for example, Japanese Patent Application Laid-Open Publication No. 2015-172523).

However, when the reception target is simply reduced, the possibility of misidentification due to reduction of reception sensitivity and misidentification with different code sequence portions increases.

SUMMARY

According to an embodiment of the present invention, there is a device comprising: one or more processors configured to: determine an elapsed time since a correction of a calculated date and time calculated by a time calculating circuit; estimate a degree of deviation included in the calculated date and time, based on the elapsed time; and in response to estimating the degree of deviation to be equal to or smaller than a first predetermined range, execute a first method among a plurality of methods to correct the calculated date and time, by which the one or more processors are configured to: generate an expected code sequence of a code sequence in a satellite radio wave to be received from a satellite; control a satellite radio wave receiver to receive the code sequence in the satellite radio wave; determine whether there is a match between the expected code sequence and the code sequence of the satellite radio wave; in response to determining that there is a match, obtain a first present date and time information represented by the expected code sequence; and correct the calculated date and time, based on the first present date and time information obtained.

According to another embodiment of the present invention, there is an electronic timepiece comprising the above-described device.

According to another embodiment of the present invention, there is a device comprising: means for determining an elapsed time since a correction of a calculated date and time calculated by a time calculating circuit; means for estimating a degree of deviation included in the calculated date and time, based on the elapsed time; and means for, in response to estimating the degree of deviation to be equal to or smaller than a first predetermined range, executing a first method among a plurality of methods to correct the calculated date and time, the first method comprising: generating an expected code sequence of a code sequence in a satellite radio wave to be received from a satellite; controlling a satellite radio wave receiver to receive the code sequence in the satellite radio wave; determining whether there is a match between the expected code sequence and the code sequence of the satellite radio wave; in response to determining that there is a match, obtaining a first present date and time information represented by the expected code sequence; and correcting the calculated date and time, based on the first present date and time information obtained.

According to another embodiment of the present invention, there is a method comprising: determining an elapsed time since a correction of a calculated date and time calculated by a time calculating circuit; estimating a degree of deviation included in the calculated date and time, based on the elapsed time; and in response to estimating the degree of deviation to be equal to or smaller than a first predetermined range, executing a first method among a plurality of methods to correct the calculated date and time, the first method comprising: generating an expected code sequence of a code sequence in a satellite radio wave to be received from a satellite; controlling a satellite radio wave receiver to receive the code sequence in the satellite radio wave; determining whether there is a match between the expected code sequence and the code sequence of the satellite radio wave; in response to determining that there is a match, obtaining a first present date and time information represented by the expected code sequence; and correcting the calculated date and time, based on the first present date and time information obtained.

According to another embodiment of the present invention, there is a non-transitory computer-readable storage device storing instructions that cause one or more computers to at least: determine an elapsed time since a correction of a calculated date and time calculated by a time calculating circuit; estimate a degree of deviation included in the calculated date and time, based on the elapsed time; and in response to estimating the degree of deviation to be equal to or smaller than a first predetermined range, execute a first method among a plurality of methods to correct the calculated date and time, the first method comprising: generating an expected code sequence of a code sequence in a satellite radio wave to be received from a satellite; controlling a satellite radio wave receiver to receive the code sequence in the satellite radio wave; determining whether there is a match between the expected code sequence and the code sequence of the satellite radio wave; in response to determining that there is a match, obtaining a first present date and time information represented by the expected code sequence; and correcting the calculated date and time, based on the first present date and time information obtained.

DETAILED DESCRIPTION OF THE PREFERRED EMBODIMENTS

An embodiment of the present invention is described with reference to the drawings.

Figure 1:
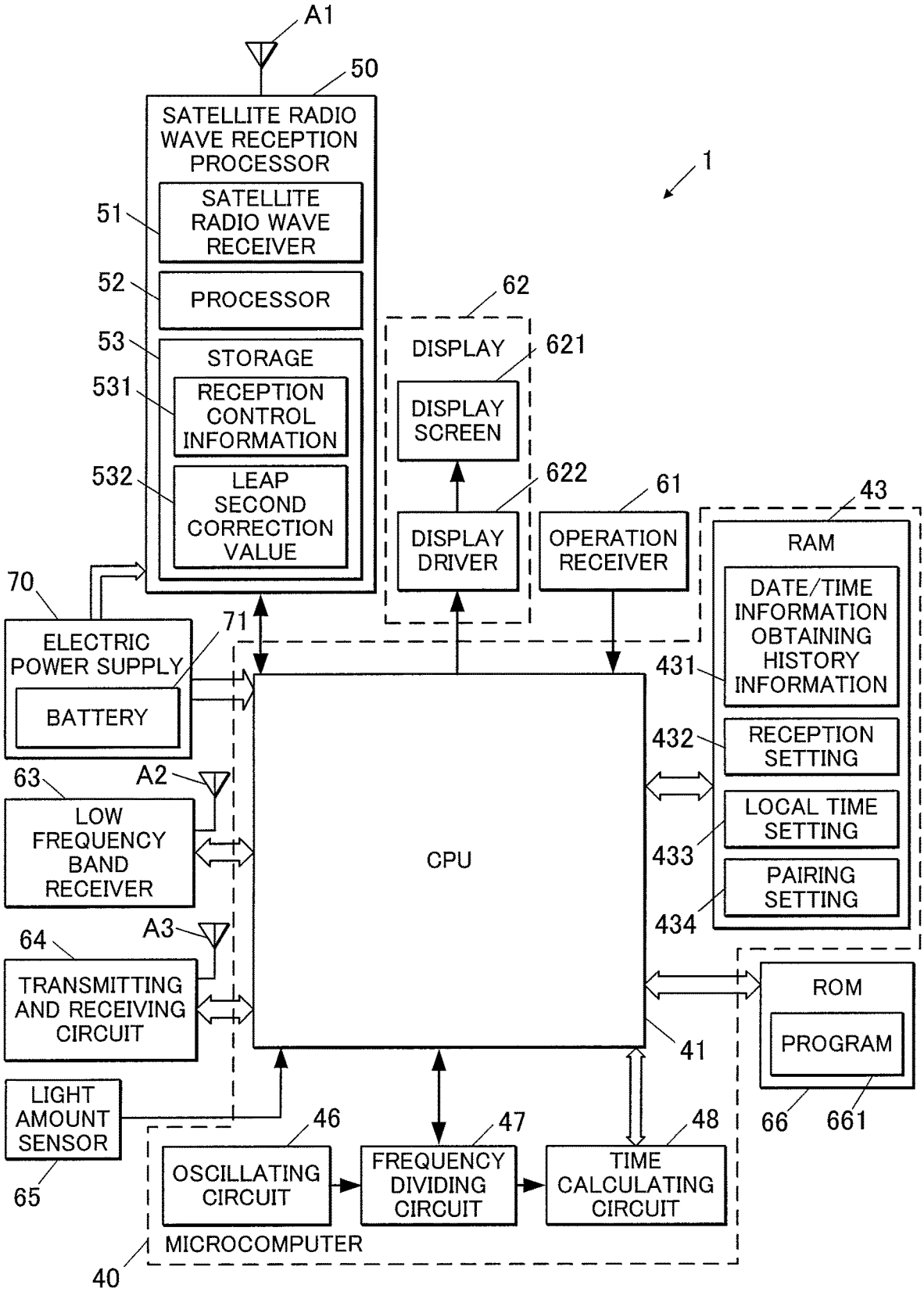
FIG. 1 is a block diagram showing a functional configuration of an electronic timepiece according to an embodiment of the present invention.

FIG. 1 is a block diagram showing a functional configuration of an electronic timepiece 1 according to the present embodiment.

The electronic timepiece 1 includes a microcomputer 40, a satellite radio wave reception processor 50 and an antenna A1, an operation receiver 61, a display 62, a low frequency band receiver 63 and an antenna A2, a transmitting and receiving circuit 64 and an antenna A3, a light amount sensor 65, a ROM (Read Only Memory) 66, and an electric power supply 70.

The microcomputer 40 collectively controls the entire operation of the electronic timepiece 1. The microcomputer 40 includes a Central Processing Unit (CPU) 41 (selecting unit), a Random Access Memory (RAM) 43, an oscillating circuit 46, a frequency dividing circuit 47, and a clock circuit 48 (time-calculating unit). Control operations include, in addition to various control operations regarding normal date/time display operation, obtaining present date/time information and correcting the date and time calculated by the clock circuit 48, and operations according to various functions included in the electronic timepiece 1. Examples of such functions include, an alarm notifying function, a timer function and a stopwatch function. The microcomputer 40 is able to limit some functions such as limiting contents displayed and brightness in a display screen 621 so as to reduce the amount of consumed electric power and to switch the mode to the sleep mode according to the remaining amount of a battery 71 of the electric power supply 70 and the state that the electric timepiece 1 is not used at night.

The CPU 41 is a processor which performs various computing processes and which performs control operation.

The RAM 43 provides a memory space for jobs to the CPU 41 and stores temporary data.

A local time setting 433 is stored in the RAM 43. The local time setting 433 includes time zone setting and summer time setting when the present date and time in a region set from anywhere around the world such as the present position (that is, local time) is displayed and used. That is, the local time setting 433 is time difference information from the UTC date/time and information regarding the position (for example, city). The local time setting 433 includes information regarding whether there is a receivable standard time radio wave in the position (for example, city) and type of standard time radio wave.

The RAM 43 stores date/time information obtaining history information 431, reception setting 432, and pairing setting 434. The date/time information obtaining history information 431 includes source of present date/time information obtained from external sources in the past and the date and time when the information was obtained. The information of the source and the date and time is stored in the date/time information obtaining history information 431 for at least one recent occasion, but the information can be stored for a plurality of occasions. The date/time information obtaining history information 431 may include information for an occasion when an attempt to obtain information was made but the attempt failed.

The reception setting 432 is setting information when a method that the satellite radio wave reception processor 50 uses to receive date and time for the next occasion is set in advance according to the recent date/time information obtaining operation. As described later, the reception setting 432 includes partial data reception setting, entire data reception setting and no setting which is neither of the above.

The pairing setting 434 stores identification information showing the external devices with which the transmitting and receiving circuit 64 is able to communicate using short-range wireless communication. When short-range wireless communication is performed, a request for connection is transmitted to the external devices based on the identification information of the pairing setting 434.

The oscillating circuit 46 generates and outputs a signal with a predetermined frequency. For example, a crystal oscillator is used to generate signals. Such crystal oscillator can be attached outside the microcomputer 40.

The frequency dividing circuit 47 outputs a frequency dividing signal dividing a frequency signal input from the oscillating circuit 46 at a set frequency dividing ratio. The setting of the frequency dividing ratio can be changed with the CPU 41.

The clock circuit 48 calculates the present date and time (the time and date) by calculating the frequency dividing signal input from the frequency dividing circuit 47 at a predetermined frequency and stores the present date and time. The accuracy of the date and time calculated by the clock circuit 48 changes depending on the external environment, mainly surrounding temperatures. Normally, there is a deviation of about 0.5 seconds a day in the accuracy, but as the deviation from standard temperatures (for example, about 20° C.) becomes larger, the accuracy decreases. For example, in extreme environments such as inside a car on a sunny day or outside during a severe winter, larger deviation in accuracy (for example, 3 seconds per day) may occur. The CPU 41 may correct the calculated date and time based on the present date and time obtained according to the standard time radio wave obtained by the satellite radio wave reception processor 50 and the transmitting and receiving circuit 64 or received by the low frequency band receiver 63.

The satellite radio wave reception processor 50 receives and processes the transmitting radio wave from the positioning satellite regarding the satellite positioning system (GLASS; Global Navigation Satellite System) such as the GPS (Global Positioning System) of the United States, obtains the information such as the present date/time and present position, and outputs the information requested from the CPU 41 to the CPU 41 in a predetermined format. The satellite radio wave reception processor 50 includes a satellite radio wave receiver 51 (satellite radio wave receiving unit), a processor 52, and a storage 53.

The satellite radio wave receiver 51 performs the capturing process which receives and detects the transmitting radio wave from the positioning satellite as the reception target, and identifies the positioning satellite and phase of the transmitting signal. The satellite radio wave receiver 51 tracks the transmitted radio wave from the positioning satellite based on the identification information and phase of the captured positioning satellite and continuously demodulates and obtains the transmitting signal (navigation message).

The processor 52 includes a CPU and performs various types of control on the operations performed in the satellite radio wave reception processor 50. The processor 52 controls the satellite radio wave receiver 51 so that the radio waves from the positioning satellites are received at a suitable timing according to the instruction from the microcomputer 40, performs the process according to a plurality of types of later-described methods of obtaining the present date and time and obtains the necessary information, and identifies the present date and time and calculates the present position (that is, positioning).

The CPU 41 and the processor 52 compose the processor and the date/time correcting unit in the electronic timepiece 1 of the present embodiment.

The storage 53 stores reception control information 531 such as various setting data and reception information, leap second correction value 532, and programs regarding control performed by the processor 52 in the satellite radio wave reception processor 50. Setting data includes data such as format data of the navigation message of each positioning satellite, reference data to determine reception level, and later-described WN cycle setting data. For example, the reception information includes an obtained almanac of each positioning satellite. The leap second correction value 532 stores a value to correct the deviation caused by the leap second between the date and time transmitted from the positioning satellite of the GPS (hereinafter referred to as GPS satellite) and the UTC date and time (coordinated universal time). The GPS satellite here includes GPS and positioning satellites in a complementary satellite positioning system such as Quasi-Zenith Satellite System (QZSS) which transmits a navigation message using the same format with the same transmitting frequency.

The operation receiver 61 receives input from outside such as user operation. The operation receiver 61 is provided with a press button switch or a stem, and outputs to the CPU 41 operation signals according to pressing operation on the press button switch or operations such as pulling, rotating, and pushing of the stem.

The display 62 displays various information based on control by the CPU 41. The display 62 includes a display driver 622 and a display screen 621. For example, the display screen 621 performs digital display on a Liquid Crystal Display (LCD) screen by a segment method, a dot-matrix method or a combination of the above. Alternatively, instead of the digital display on the display screen 621, the display 62 may be a display including hands and a stepping motor to rotate the hands. The display driver 622 outputs the driving signal to the display screen 621 based on the control signal from the microcomputer 40 so that the display screen 621 performs suitable display.

The low frequency band receiver 63 receives and demodulates the standard time radio wave which transmits a signal (time code) including present date/time information (including time information and date information) at a low frequency band through the antenna A2. In the time code, the date/time data showing a certain minute is encoded and transmitted at a one minute cycle. The electronic timepiece 1 confirms matching of a plurality of reception results (date and time obtained from the received code sequence) such as three receptions, and obtains the accurate present date and time. Therefore, when the reception situation is good, the reception operation time is about 3 to 4 minutes for each reception.

JJY (registered trademark) of Japan, WWVB of the United States, MSF of Great Britain, and DCF77 of Germany are widely used standard time radio waves. The standard time radio wave which is to be the reception target is determined according to the above-described local time setting 433, or the standard time radio wave is not set as the reception target when all of the standard time radio waves are outside the reception area.

The transmitting and receiving circuit 64 performs various operation for short-range wireless communication with external electronic devices (external devices) using the antenna A3 based on control by the CPU 41, specifically communication by Bluetooth (registered trademark) (mainly version 4.0 which is low in energy consumption). The transmitting and receiving circuit 64 performs control operation based on the determined communication standards. The transmitting and receiving circuit 64 demodulates and obtains communication data for the electronic timepiece 1, outputs the data to the CPU 41, and demodulates the communication data for the external devices with which communication is established to output the data as communication radio waves. The identification information of the external device with which communication is established is stored in the above pairing setting 434, and usually, the transmitting and receiving circuit 64 transmits the request for communication to the external device shown in the identification information. The present date/time information can be obtained from the external device. When the communication is performed for the purpose of obtaining the present date/time information, other than the control signal regarding establishing and cutting communication, the communication between the external device and the electronic timepiece 1 is a request for present date/time information and a signal as a response. Therefore, the communication time is one second or shorter, and the amount of communication is very small.

Although the external device which is to be the target of short-range wireless communication is not limited, mainly portable terminals including smartphones and cellular phones are used. By storing the identification information (pairing setting 434) of such external devices in advance, communication is established when the request for communication is made from the electronic device 1 using the identification information if the external device is operating within a communicable range.

For example, the light amount sensor 65 is provided aligned with the display screen of the display 62, and the light amount irradiated from outside is measured. For example, a photodiode is used as the light amount sensor 65. The light amount sensor 65 outputs an electric signal (voltage signal and current signal) according to the incident light amount. The electric signal is digitally sampled in an analog/digital convertor (ADC) (not shown) and input in the CPU 41.

The ROM 66 stores a program 661 used for control operations performed by the CPU 41 and initial setting data. The ROM 66 may be a nonvolatile memory such as a flash memory in which data is rewritable in addition to or instead of a mask ROM. The program 661 includes a control program to obtain the present date and time. The initial setting data includes time zone setting in each region of the world, time difference information from the UTC date/time such as summer time setting, information regarding the position (for example, city), and information of existence and type of receivable standard time radio wave in the position (for example, city). The setting data of the position (for example, city) belonging to the present position is stored in the RAM 43 and used. The ROM 66 is attached externally to the microcomputer 40 but may be formed as one with the microcomputer 40.

The electric power supply 70 supplies to the units in the electronic timepiece 1 the power necessary to operate the units. The electronic power supply 70 supplies the power output from the battery 71 at an operation voltage for each unit. When the operation voltage is different according to the operation site, the electric power supply 70 uses the regulator to convert the voltage and outputs the voltage. The battery 71 may include a solar panel which generates electricity according to the incident light or a secondary battery which accumulates the charged power. Alternatively, a dry battery or a rechargeable battery can be attached detachably as the battery 71.

Next, the operation to obtain the present date/time information in the electronic timepiece 1 according to the present embodiment is described.

As described above, the date and time calculated by the clock circuit 48 of the electronic timepiece 1 may deviate at a maximum of about 0.5 seconds per day in normal conditions. When the temperature conditions are severe, the deviation may be a maximum of about 3 seconds per day. The electronic timepiece 1 obtains the accurate present date and time from external devices periodically or in response to a predetermined instruction by a user, and the clock circuit 48 corrects the calculated date and time. With this, the deviation in the date and time calculated by the clock circuit 48 is maintained to be slight.

The electronic timepiece 1 obtains present date/time information from three sources as described below, present date/time obtained by the satellite radio wave reception processor 50, present date/time information obtained from the standard time radio wave received by the low frequency band receiver 63, and present date/time information obtained from the external device by Bluetooth communication through the transmitting and receiving circuit 64.

The date and time based on the standard time radio wave received by the low frequency band receiver 63 is normally obtained at a sufficient accuracy (about 10 msec).

Examples of the present date/time information obtained from the external devices through the transmitting and receiving circuit 64 include obtaining the date and time calculated by the external device and obtaining the date and time based on the result of the date and time obtained by the satellite radio wave reception processor provided in the external device. When the external device includes the portable telephone function, the present date/time information is obtained from the base station of the portable telephone communication. When the external device includes an internet connection function, the present date/time information obtained from the time server on the internet is obtained indirectly through the external device. Among the above, when it is possible to obtain the date and time calculated by the external device itself, the deviation occurs similar to the date and time calculated by the clock circuit 48. In the example described below, it is not possible to obtain information regarding the accuracy of the date and time obtained from the external device, but when such information regarding the accuracy of the date and time transmitted from the external device can be obtained, the information can be used.

The date and time obtained from the satellite radio wave reception processor 50 normally has sufficient accuracy (for example, deviation of 10 to 100 msec or less). When the date and time are obtained based on the radio wave from the GPS satellite, a separate leap second correction value 532 is necessary. The GPS satellite transmits the date and time not considering the leap second. Therefore, the satellite radio wave reception processor 50 converts the date and time to UTC date/time based on the leap second correction value 532 showing the amount of time of deviation from the UTC date/time which considers the leap second and outputs the UTC date/time. The leap second correction value 532 can be obtained from the GPS satellite but the frequency of obtaining the value is low (once every 12.5 minutes). Therefore, the value can be received to match the timing of transmitting from the GPS satellite or the value can be obtained from external devices through the transmitting and receiving circuit 64.

At present, the leap second may be added or subtracted once every 6 months. The leap second is added or subtracted for a predetermined number of seconds (at present, only 1 second) at the above timing. Therefore, if there is no prior notice information before the leap second can be added or subtracted, that is, when information regarding whether the leap second will be added or subtracted or when prior notice information of the amount of time of deviation after the timing that adding or subtracting the leap second is possible is not obtained, the date and time obtained from the satellite radio wave reception processor 50 may be deviated for 1 second until the information of the deviation time is obtained after the timing that the leap second can be added or subtracted.

Among the standard radio waves, JJY and WWVB transmit at a predetermined term before the timing that the leap second can be added or subtracted prior notice information of whether the leap second will be added or subtracted. Therefore, the deviation time can be corrected at the timing that the leap second can be added or subtracted based on the prior notice information.

The electronic timepiece 1 according to the present embodiment selects the method of obtaining the present date/time information from the above. Here, when the pairing setting is set, the present date/time information is obtained through the transmitting and receiving circuit 64 at fixed intervals a plurality of number of times a day (for example, 2 to 4 times) and when communication is performed for the purpose of transmitting and receiving information other than the date and time. Independent from the above, the standard time radio wave is received by the low frequency band receiver 63 at a predetermined timing once a day when in the reception area of the standard radio wave. When outside of the reception area of the standard time radio wave or when reception of the standard radio wave did not succeed in the reception area, the date and time are obtained by receiving the radio wave from the positioning satellite (for example, GPS satellite) using the satellite radio wave reception processor 50 at a timing that predetermined conditions are satisfied once a day and on a basis of predetermined input operation by the user.

Next, the operation of the satellite radio wave reception processor 50 obtaining the present date and time is described in detail.

Figure 2:
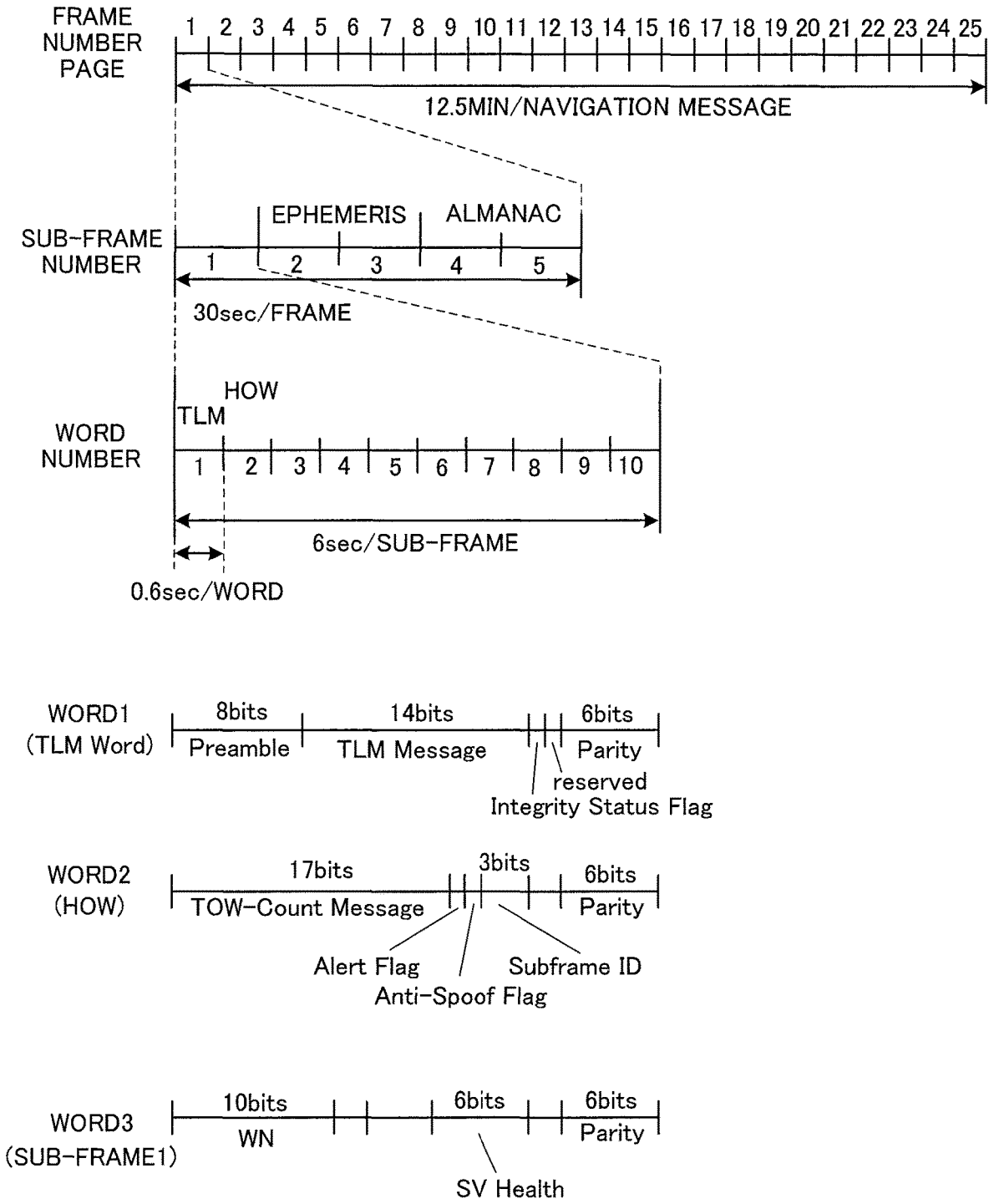
FIG. 2 is a diagram which describes a format of a signal (navigation message) transmitted from a GPS satellite.

FIG. 2 is a diagram describing the format of the navigation message transmitted by radio waves from the GPS satellite.

Each GPS satellite transmits a total of 25 pages of frame data in a unit of 30 seconds and all data (sequence of data) is output at a cycle of 12. 5 minutes. A unique C/A code is used for each GPS satellite, and 1023 codes (chips) are arranged at 1.023 MHz and repeated at a cycle of 1 msec. The top of the chip is synchronized with the internal clock of the GPS satellite. By detecting the deviation of the phase for each GPS satellite, the transmitting time, that is, the phase deviation according to the distance from the GPS satellite to the present position (pseudo distance) is detected.

Each frame data includes 5 sub-frames (6 seconds each). Further, each sub-frame includes 10 words (code block, 0.6 seconds each, WORD 1 to WORD 10). Each word is 30 bit long (that is, 30 binary codes).

The data format of WORD 1 and WORD 2 is the same in all sub-frames. That is, the contents of WORD 1 and WORD 2 can be obtained from any sub-frame every 6 seconds. WORD 1 transmits a telemetry word (TLM Word). In the telemetry word, after a preamble of a fixed code sequence of 8 bits, a telemetry message (TLM message) of 14 bits is included, and after this a 1 bit Integrity Status Flag, a 1 bit extra bit, and a parity code sequence (parity check code) of 6 bits follow. WORD 2 transmits a handover word (Handover Word; HOW). In the HOW, after the TOW-count (also called Z count) of 17 bits showing elapsed time within the week, the Alert Flag and the Anti-Spoof Flag are each shown with 1 bit. Then, the sub-frame ID showing the sub-frame number (cycle number) is shown with 3 bits, and then 2 bits for matching the parity code sequence and the parity code sequence of 6 bits are arranged.

The contents from WORD 3 and after are different depending on the sub-frame. A WN (Week Number) of 10 bits are included at the top in the WORD 3 of the sub-frame 1. Mainly, the sub-frames 2 and 3 include the ephemeris. That is, such information is obtained in the frame for 30 seconds each time. In a part of the sub-frame 4 and in the sub-frame 5, the almanac of the positioning satellite included in each determined page is transmitted. The above-described leap second correction value is transmitted once every 12.5 minutes in only frame 4 of the 18th page.

Normally, in order to decipher a navigation message, the fixed code sequence (preamble) included at the top of each sub-frame needs to be identified. The date and time shown by TOW-Count in each sub-frame is the date and time in the top timing of the next sub-frame.

The information necessary for the satellite radio wave reception processor 50 to obtain the present date and time is different depending on the degree of the deviation that may be included in the date and time calculated by the clock circuit 48. If there is not a large deviation in the date and time calculated by the clock circuit 48 (that is, equal to or smaller than a predetermined range) (for example, the date or week is not different), only a portion of the data (for example, TOW-Count) is obtained from any of the sub-frames (necessary amount of time is about 2 to 6 seconds), and by combining with the date and time calculated by the clock circuit 48, the accurate date and time are obtained (obtaining by partial data reception). When partial data is received, up to WORD 3 of one sub-frame is received so that depending on the reception timing, WN included in WORD 3 of sub-frame 1 can be received. When there may be a large deviation (that is, equal to or bigger than a predetermined range) in the date and time calculated in the clock circuit 48, the WN of the sub-frame 1 is also received, that is, the entire data regarding the date and time is obtained from the navigation message (about 3 to 30 seconds) and the date and time are obtained by the information obtained from the GPS satellite without considering the date and time calculated by the clock circuit 48 (obtaining by entire data reception). Here, the "entire data regarding date and time" does not include the correction information regarding the correction value of the leap second described below.

If the deviation of the date and time calculated by the clock circuit 48 is sufficiently small (that is, equal to or smaller than a predetermined range) (for example, ±3 seconds or less), the contents of the received navigation message, that is, the fixed code sequence of 8 bits at the top of each sub-frame (preamble), the TOW-Count of 17 bits and the sub-frame ID of 3 bits in HOW can be assumed in advance. The extra bit included in the telemetry word and HOW, Integrity Status Flag, Alert Flag, and Anti-Spoof Flag which are 1 bit codes not set in the normal transmitting state can be assumed in a reset state. Therefore, it is possible to obtain by expected reception which obtains the present date and time based on the date and time shown by the expected code sequence generated by the code assumed in advance and the timing that the code sequence matching the expected code sequence is received. According to such expected reception, there is no need to decipher (decode) the code sequence again when the code sequence is received and there is only the need to determine the match with the expected code sequence. The navigation message transmitted from the positioning satellite may be inverted for each word (30 bits), and the inverted code sequence may also be generated to determine the match. The code sequence which completely matches with the expected code sequence may be handled the same as the code sequence which completely does not match with the expected code sequence to detect the expected code sequence.

When the satellite radio wave reception processor 50 obtains the present date and time, the electronic timepiece 1 estimates the degree of deviation which may be included in the date and time calculated by the clock circuit 48 based on the obtaining situation and timing of the recent present date/time information, that is, the elapsed time since the date and time are corrected. Then, based on the degree of the deviation, the method of obtaining the date and time is selected and specified from the above-described obtaining by entire data reception, partial data reception, and expected reception, and the present date and time are obtained by the satellite radio wave reception processor 50.

Such selection operation is performed by the CPU 41, and in addition to the date/time obtaining instruction, the information of the selected obtaining method and the necessary information such as the date and time calculated by the clock circuit 48 are transmitted and output to the satellite radio wave reception processor 50. With this, the satellite radio wave reception processor 50 obtains the present date and time.

Figure 3:
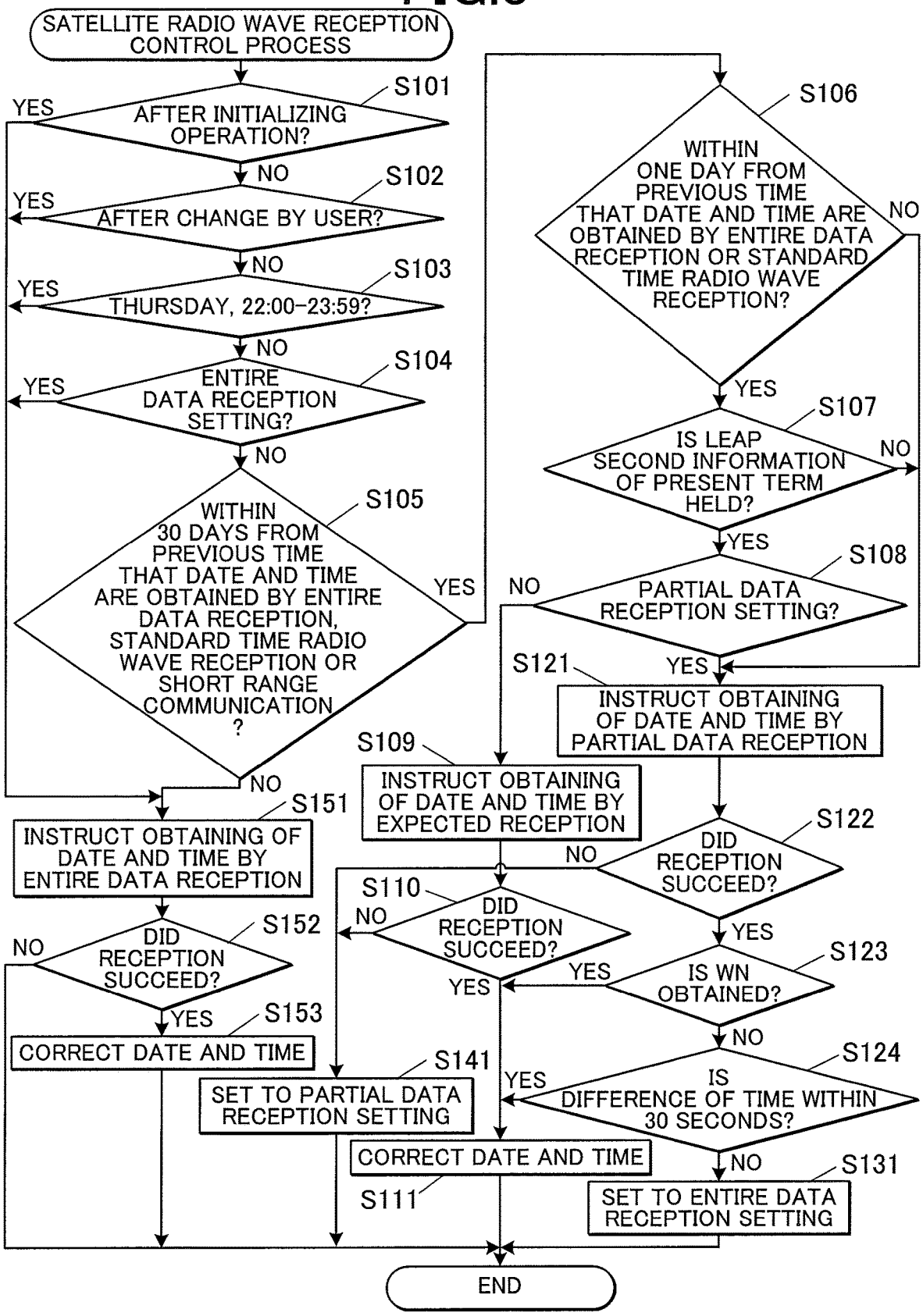
FIG. 3 is a flowchart showing a control process of a satellite radio wave reception control process performed in an electronic timepiece according to an embodiment of the present invention.

FIG. 3 is a flowchart showing a control process performed in the CPU 41 in the satellite radio wave reception control process performed in the electronic timepiece 1 according to the present embodiment. The satellite radio wave reception control process which is the date/time obtaining control method according to the present embodiment is started at the timing when the condition for obtaining the present date and time by satellite radio wave reception is satisfied or when the instruction by the user to obtain the present date and time by the satellite radio wave reception is obtained. The satellite as the reception target is described as the GPS satellite.

When the satellite radio wave reception control process starts, the CPU 41 determines whether the present obtaining operation of the date and time is after the initializing operation such as after the battery runs out (step S101). When it is determined that it is after the initializing operation ("YES" in step S101), the process of the CPU 41 advances to step S151.

When it is determined that it is not after the initializing operation ("NO" in step S101), the CPU 41 determines whether the date/time setting is performed manually by the user (step S102). When it is determined that the date/time setting is performed manually ("YES" in step S102), the process of the CPU 41 advances to step S151.

When it is determined that the date/time setting is not performed manually ("NO" in step S102), the CPU 41 determines whether the present date and time calculated by the clock circuit 48 is between 22 hours 0 minutes and 23 hours 59 minutes on Thursday (step S103). The above term is the term when the code sequence of TOW-Count is similar to the code sequence of the preamble, and the process in step S103 is to avoid misidentification of the date and time by mixing the above. When it is determined that it is within the above term ("YES" in step S103), the process of the CPU 41 advances to step S151.

When it is determined that it is not the above term ("NO" in step S103), the CPU 41 determines whether "entire data reception setting" is set in the previous reception of the satellite radio wave and the setting is turned off or not (step S104). When it is determined that the "entire data reception setting" is set ("YES" in step S104), the process of the CPU 41 advances to step S151.

When it is determined that the "entire data reception setting" is not set ("NO" in step S104), the CPU 41 determines whether it is within 30 days from the last occasion that the date and time was obtained by entire data reception, standard radio wave reception or short-range wireless communication (step S105). When it is determined that it is not within 30 days ("NO" in step S105), the process of the CPU 41 advances to step S151. When it is determined that it is within 30 days ("YES" in step S105), the process of the CPU 41 advances to step S106.

When the process advances to step S151 from any of the determining processes of steps S101 to step S105, the CPU 41 outputs an obtaining (obtaining by entire data reception) instruction of the present date/time information by the obtaining by entire data reception to the satellite radio wave reception processor 50 (processor 52) (step S151). The CPU 41 waits for input of the signal from the satellite radio wave reception processor 50 and determines whether the reception of the satellite radio wave and the obtaining of the date and time succeeded on the basis of the result of the obtaining by entire data reception input from the satellite radio wave reception process (step S152). When it is determined that the process succeeded ("YES" in step S152), the CPU 41 corrects the date and time calculated by the clock circuit 48 (step S153) and ends the satellite radio wave reception control process. When it is determined that the process did not succeed (failed) ("NO" in step S152), the CPU 41 ends the satellite radio wave reception control process.

When the result is "YES" in the determining process of step S105, the CPU 41 determines whether it is within one day of obtaining the date and time from the previous obtaining by entire data reception or standard time reception (here, short-range wireless communication is not included) (step S106). When it is determined that it is not within one day ("NO" in step S106), the process of the CPU 41 advances to step S121.

When it is determined that it is within one day ("YES" in step S106), the CPU 41 determines whether the leap second information for the present period, that is, 6 months (first half or second half of the year) including the present date and time is held (holds the information regarding the amount of time of the deviation according to the leap second as the leap second correction value 532) (step S107). When it is determined that the information is not held ("NO" in step S107), the process of the CPU 41 advances to step S121.

When it is determined that the information is held ("YES" in step S107), the CPU 41 determines whether "partial data reception setting" is set in the previous satellite radio wave reception control process and whether the setting is turned off or not (step S108). When it is determined that the "partial data reception setting" is set ("YES" in step S108), the process of the CPU 41 advances to step S121. When it is determined that the "partial data reception setting" is not set ("NO" in step S108), the process of the CPU 41 advances to step S109.

When the process advances to step S121 in any of the determining processes of steps S106 to S108, the CPU 41 outputs the obtaining instruction of the present date/time information by partial data reception to the satellite radio wave reception processor 50 (processor 52) (step S121). The CPU 41 waits for the input of the signal from the satellite radio wave reception processor 50 and determines whether the reception of the satellite radio wave or the obtaining of the date and time succeeded based on the result of the obtaining by partial data reception input from the satellite radio wave reception processor 50 (step S122). When it is determined that the process did not succeed (failed) ("NO" in step S122), the CPU 41 performs the "partial data reception setting" (step S141) and ends the satellite radio wave reception control process.

When it is determined that the process succeeded ("YES" in step S122), the CPU 41 determines whether the WN is obtained in the reception (step S123). When it is determined that the WN is obtained ("YES" in step S123), the process of the CPU 41 advances to step S111. When it is determined that the WN is not obtained ("NO" in step S123), the CPU 41 determines whether the difference between the present date and time calculated by the clock circuit 48 and the obtained present date and time is within a predetermined reference time used for determining consistency with the obtained present date and time, here, within 30 seconds (step S124). When it is determined that the difference is within 30 seconds ("YES" in step S124), the process of the CPU 41 advances to step S111. When it is determined that the difference is not within 30 seconds ("NO" in step S124), the CPU 41 performs "entire data reception setting" (step S131) and ends the satellite radio wave reception control process.

In the determining process of step S108, when it is determined that the "partial data reception setting" is not set ("NO" in step S108), the CPU 41 outputs the date/time obtaining instruction by expected reception to the satellite radio wave reception processor 50 (processor 52) (step S109). The CPU 41 waits for input of the signal from the satellite radio wave reception processor 50 and determines whether the reception succeeded and the date and time are obtained based on the result of expected reception input from the satellite radio wave reception processor 50 (step S110). When it is determined that the reception did not succeed ("NO" in step S110), the process of the CPU 41 advances to step S141 (obtaining by expected reception is not performed in the next reception). When it is determined that the reception succeeded ("YES" in step S110), the process of the CPU 41 advances to step S111.

When the process advances from any of the processes of steps S110, S123, and S124 to the process of step S111, the CPU 41 modifies the date and time calculated by the clock circuit 48 based on the obtained date and time (step S111). The CPU 41 ends the satellite radio wave reception controlling process.

Among the above processes, the processes of steps S101 to S109, S121, S151 compose the obtaining method selection step in the date/time obtaining control method according to the present embodiment (obtaining method selection process performed by the device, obtaining method selecting unit).

As described above, the electronic timepiece 1 according to the present embodiment includes a clock circuit 48 which calculates the date and time, a satellite radio wave receiver 51 in a satellite radio wave reception processor 50 which receives the radio wave from the positioning satellite, and a CPU 41 and a processor 52 which performs the control operation regarding obtaining the present date/time information and which corrects the date and time calculated by the clock circuit 48 based on the obtained present date/time information. When the CPU 41 controls the radio wave reception of the satellite radio wave receiver 51 of the satellite radio wave reception processor 50 to obtain the present date and time, the CPU 41 selects any of the plurality of types of obtaining methods of the present date and time based on the elapsed time from the last occasion that the date and time calculated by the clock circuit 48 was corrected, and the CPU 41 outputs the instruction to perform the obtaining operation of the present date and time according to the obtaining method selected by the processor 52. The obtaining by expected reception is included in the plurality of types of obtaining methods of the present date and time. The obtaining by expected reception is a method in which an expected code sequence assumed to be received by the satellite radio wave reception processor 50 is generated according to the date and time calculated by the clock circuit 48 and the present date and time based on the timing that the expected code sequence is received is obtained.

As described above, the maximum deviation amount of the calculated date and time is estimated based on the elapsed time from the recent date and time correction. By expected reception of the date and time when the deviation amount is within an acceptable range, the present date and time are determined immediately at the point when the code sequence matching with the expected code sequence is detected. Therefore, the secure and accurate date and time can be obtained within a short amount of time in the electronic timepiece 1. Moreover, there is hardly a difference between the range of the expected code sequence and the range of reception and decoding when partial data is received. Therefore, normally, the amount of time of reception does not become long. The process of generating the expected code sequence is easy, and since the post process such as decoding is not necessary, the possibility of misidentification does not rise. With this, secure and accurate identification of the date and time is possible while shortening the amount of time necessary for obtaining the date and time.

The plurality of types of obtaining methods include, obtaining by partial data reception in which the satellite radio wave reception processor 50 obtains partial data from a sequence of data transmitted from the positioning satellite, the partial data which can be combined with the date and time calculated by the clock circuit 48 to obtain the present date and time, and obtaining by entire data reception which obtains all of the data regarding the present date and time included in the sequence of data.

As described above, by suitable reception employing combinations with conventional reception methods according to the assumed maximum deviation amounts, reception within a short time which has high risks is not performed when the deviation amount may be large, and the obtaining method with high efficiency and certainty is selected. Therefore, it is possible to surely obtain the accurate present date and time.

When the CPU 41 controls the satellite radio wave receiver 51 to receive the radio wave from the GPS satellite to obtain the present date and time, the CPU 41 determines whether the leap second correction value 532 for the present deviation time according to the leap second of the date and time calculated by the GPS satellite is held. When the leap second correction value 532 is not held, the obtaining by expected reception is not selected. That is, the CPU 41 outputs to the processor 52 of the satellite radio wave reception processor 50 the instruction to obtain the present date and time by an obtaining method other than the obtaining by expected reception.

When the date and time not considering the leap second as in the GPS satellite is transmitted, if the accurate leap second correction value is not held, the deviation may occur in the unit of seconds, and the accuracy of reception and identification of the expected code sequence drastically decreases. Therefore, in such case, by switching to the conventional obtaining methods by partial data reception, the risk of not being able to obtain the accurate date and time decreases, and the present date and time can be obtained efficiently.

The electronic timepiece 1 includes a transmitting and receiving circuit 64 which performs short-range wireless communication such as Bluetooth, and the CPU 41 is able to obtain the present date/time information from the external devices through the transmitting and receiving circuit 64. When the CPU 41 recently obtained the present date/time information through the transmitting and receiving circuit 64, the CPU 41 does not select the obtaining by expected reception.

When the present date and time are obtained from an external device, the obtained present date and time depend on the accuracy of the calculation by the external device. The electronic devices which are able to perform short-range wireless communication lately such as smartphones and cellular phones which are assumed to be mainly used as the external device perform positioning themselves or synchronize with the date and time of the base station of the cellular phone or the time server of the network. Therefore, the possibility that the date and time are calculated with a large deviation amount is low. However, the above is not definite, and in such cases, the secure date and time can be obtained instead of raising risks of not obtaining the accurate date and time.

When the attempt by the satellite radio wave reception processor 50 to obtain the present date and time by expected reception failed previously, the CPU 41 does not select obtaining by expected reception the next time the present date and time are obtained by receiving the radio wave from the positioning satellite.

That is, when the obtaining by expected reception fails, the CPU 41 does not attempt the obtaining by expected reception twice consecutively. With this, the risk decreases, and the date and time can be obtained more securely.

The device configured to obtain the date/time information provided with one or a plurality of processors (here, CPU 41 and processor 52) selects the method of obtaining the present date and time among the plurality of types of methods based on the elapsed time from the last occasion that date and time calculated by the clock circuit 48 was corrected when the satellite radio wave receiver 51 receives the radio wave to obtain the present date and time. The plurality of types of obtaining methods include the obtaining by expected reception in which the expected code sequence assumed to be received by the satellite radio wave receiver 51 is generated according to the date and time calculated by the clock circuit 48 and the present date and time are obtained based on the timing that the expected code sequence is received.

The date and time is obtained with options that can be selected as the method of obtaining the date and time, and more secure and accurate present date and time can be obtained efficiently within a short amount of time. That is, the device may output the reception instruction to the external satellite radio wave receiver 51 to obtain the date and time.

The date/time obtaining control method of the present embodiment includes the obtaining method selection step. When the satellite radio wave receiver 51 receives the radio wave from the positioning satellite and obtains the present date and time, the obtaining method of the present date and time is selected from the plurality of types of obtaining methods based on the elapsed time from the last occasion that the date and time calculated by the clock circuit 48 was corrected, and the instruction to obtain the present date and time according to the selected obtaining method is output to the processor 52. The plurality of types of obtaining methods include the obtaining by expected reception in which the expected code sequence assumed to be received by the satellite radio wave receiver 51 is generated according to date and time calculated by the clock circuit 48 and the present date and time are obtained on the basis of the timing that the expected code sequence is received.

According to selection of the date/time obtaining method as described above, it is possible to efficiently obtain the secure and accurate present date and time within a short amount of time.

The program 661 according to the present embodiment allows the computer (for example, microcomputer 40, processor 52) of the electronic timepiece 1 to function as the obtaining method selection unit. When the satellite radio wave receiver 51 receives the radio wave from the positioning satellite and obtains the present date and time, the obtaining method of the present date and time are selected from the plurality of types of obtaining methods based on the elapsed time from the last occasion that the date and time calculated by the clock circuit 48 were corrected, and the instruction to obtain the present date and time according to the selected obtaining method is output to the processor 52. The plurality of types of obtaining methods include the obtaining by expected reception in which the expected code sequence assumed to be received by the satellite radio wave processor 50 is generated according to the date and time calculated by the clock circuit 48 and the present date and time are obtained on the basis of the timing that the expected code sequence is received.

Since such program is installed in the processor (for example, CPU 41) and performed, the computer is able to easily perform a process to efficiently obtain the secure and accurate present date and time within a short amount of time.

The present invention is not limited to the above-described embodiment and various modifications are possible.

For example, according to the present embodiment, both the method of receiving the standard time radio wave to obtain the date and time and information to obtain the date and time from external devices using Bluetooth are used. Alternatively, one or both of the above functions are not necessary and other configurations to obtain the date and time may be included. For example, other methods of short-range wireless communication include wireless LAN. When such configurations are used, whether or not to perform the expected reception can be determined according to the accuracy of the date and time obtained by the above configurations.

According to the above embodiment, when the partial data is received, the WN is received by receiving up to WORD 3. Alternatively, the reception can be immediately cut at the timing of identifying TOW-Count in WORD 2. According to the electronic timepiece of the present embodiment, the maximum deviation amount of the date and time is estimated. The necessity to obtain WN is not high when the possibility that the deviation equal to or more than the estimated amount is very low. By increasing the number of cases of being able to obtain WN by slightly increasing the amount of time of reception, specifically 0.6 seconds for one WORD, the accuracy of the obtained date and time is enhanced.

According to the present embodiment, the type of obtaining method is selected by estimating the maximum deviation amount of the date and time calculated by the clock circuit 48 only from the elapsed time from the latest date and time correction, but other estimates are possible. For example, the temperature conditions can be considered to change the deviation amount assumed for each unit of a predetermined amount of time, and this can be added to estimate the maximum deviation amount.

According to the present embodiment, the radio wave is received from the GPS satellite, but the radio wave can be received from other positioning satellites such as the GLONASS satellite and the date and time can be obtained. In this case, whether to obtain only the time information or to also obtain the information regarding the date can be determined according to the maximum deviation amount of the date and time calculated by the clock circuit 48. Moreover, the date and time included in the navigation message transmitted from the GLONASS satellite includes the leap second. Therefore, there is no need to consider whether the leap second correction value is stored.

According to the above-described embodiment, the CPU 41 outputs the information necessary for the satellite radio wave reception processor 50 (processor 52) to generate the expected code sequence, but alternatively, the CPU 41 can generate the expected code sequence and output the expected code sequence to the satellite radio wave reception processor 50.

According to the present embodiment, the CPU 41 and the processor 52 are provided separately, alternatively, the various controlling operations can be performed with one processor.

According to the description above, as the computer readable medium which stores the program 661 regarding the satellite radio wave receiving control of the present invention when the present date/time information is obtained, nonvolatile memory such as a flash memory and the ROM 66 including the mask ROM are described. The computer readable medium is not limited to the above, and HDD (Hard Disk Drive), and portable recording mediums such as CD-ROM and DVD disk can be applied.

Other than the above, the details of the configuration, control process and display examples can be suitably changed without leaving the scope of the present invention.

The embodiments of the present invention are described above, but the scope of the present invention is not limited to the above-described embodiments. The scope of the present invention is limited to the invention as claimed and its equivalents.

What is claimed is:

1. A device comprising:

one or more processors configured to:

determine an elapsed time since a previous correction of a calculated date and time calculated by a time calculating circuit;

estimate a degree of deviation included in the calculated date and time, based on the elapsed time;

in response to estimating the degree of deviation to be equal to or smaller than a first predetermined range, execute a first method among a plurality of methods to correct the calculated date and time, by which the one or more processors are configured to:

generate an expected code sequence of a code sequence in a satellite radio wave to be received from a satellite;

control a satellite radio wave receiver to receive the code sequence in the satellite radio wave;

determine whether there is a match between the expected code sequence and the code sequence of the satellite radio wave;

in response to determining that there is a match, obtain a first present date and time information represented by the expected code sequence; and correct the calculated date and time, based on the first present date and time information obtained;

in response to estimating the degree of deviation to be greater than the first predetermined range and equal to or smaller than a second predetermined range, execute a second method among the plurality of methods to correct the calculated date and time, by which the one or more processors are configured to:

control the satellite radio wave receiver to receive a first portion of the code sequence;

obtain a second present date and time information represented by the first portion of the code sequence; and correct the calculated date and time, based on the second present date and time information obtained; and in response to estimating the degree of deviation to be greater than the second predetermined range and equal to or smaller than a third predetermined range, execute a third method among the plurality of methods to correct the calculated date and time, by which the one or more processors are configured to:

control the satellite radio wave receiver to receive a second portion of the code sequence;

obtain a third present date and time information represented by the second portion of the code sequence, wherein the third present date and time information includes additional information than the second present date and time information; and correct the calculated date and time, based on the third present date and time information obtained.

2. The device according to claim 1, wherein the one or more processors are configured to:

determine whether information on a leap second correction value is held in a memory;

in response to determining that the information on the leap second correction value is held in the memory and in response to estimating the degree of deviation to be equal to or smaller than the first predetermined range, execute the first method to correct the calculated date and time; and in response to determining that the information on the leap second correction value is not held in the memory, execute another method other than the first method among the plurality of methods to correct the calculated date and time.

3. The device according to claim 2, wherein the one or more processors are configured to:

control a short-range wireless transmitting and receiving circuit to receive a short range wireless signal;

obtain an external device present date and time information represented by the short range wireless signal;

correct the calculated date and time, based on the external device present date and time information obtained; and determine the elapsed time since the correction of the calculated date and time based on the external device present date and time information.

4. The device according to claim 3, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, select to not determine whether there is the match between the expected code sequence and the code sequence of the satellite radio wave and instead executes another method among the plurality of methods to correct the calculated date and time.

5. The device according to claim 2, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, select to not determine whether there is the match between the expected code sequence and the code sequence of the satellite radio wave and instead executes another method among the plurality of methods to correct the calculated date and time.

6. The device according to claim 1, wherein the one or more processors are configured to:

determine whether information on a leap second correction value is held in a memory;

in response to determining that the information on the leap second correction value is held in the memory and in response to estimating the degree of deviation to be equal to or smaller than the first predetermined range, execute the first method to correct the calculated date and time; and in response to determining that the information on the leap second correction value is not held in the memory, execute the second method to correct the calculated date and time.

7. The device according to claim 6, wherein the one or more processors are configured to:

control a short-range wireless transmitting and receiving circuit to receive a short range wireless signal;

obtain an external device present date and time information represented by the short range wireless signal;

correct the calculated date and time, based on the external device present date and time information obtained; and determine the elapsed time since the correction of the calculated date and time based on the external device present date and time information.

8. The device according to claim 7, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, execute the second method to correct the calculated date and time.

9. The device according to claim 6, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, execute the second method to correct the calculated date and time.

10. The device according to claim 1, wherein the one or more processors are configured to:

control a short-range wireless transmitting and receiving circuit to receive a short range wireless signal;

obtain an external device present date and time information represented by the short range wireless signal;

correct the calculated date and time, based on the external device present date and time information obtained; and determine the elapsed time since the correction of the calculated date and time based on the external device present date and time information.

11. The device according to claim 10, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, select to not determine whether there is the match between the expected code sequence and the code sequence of the satellite radio wave and instead executes another method among the plurality of methods to correct the calculated date and time.

12. The device according to claim 10, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, execute the second method to correct the calculated date and time.

13. The device according to claim 1, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, select to not determine whether there is the match between the expected code sequence and the code sequence of the satellite radio wave and instead executes another method among the plurality of methods to correct the calculated date and time.

14. The device according to claim 1, wherein the one or more processors are configured to:

in executing the first method to correct the calculated date and time, determine whether the satellite radio wave receiver received the code sequence in the satellite radio wave; and in response to determining that the satellite radio wave receiver received the code sequence in the satellite radio wave, determine whether there is the match between the expected code sequence and the code sequence of the satellite radio wave; and in response to determining that the satellite radio wave receiver did not receive the code sequence in the satellite radio wave, execute the second method to correct the calculated date and time.

15. An electronic time piece comprising:

the device according to claim 1;

the time calculating circuit; and the satellite radio wave receiver.

16. A device comprising:

means for determining an elapsed time since a previous correction of a calculated date and time calculated by a time calculating circuit;

means for estimating a degree of deviation included in the calculated date and time, based on the elapsed time;

means for, in response to estimating the degree of deviation to be equal to or smaller than a first predetermined range, executing a first method among a plurality of methods to correct the calculated date and time, the first method comprising:

generating an expected code sequence of a code sequence in a satellite radio wave to be received from a satellite;

controlling a satellite radio wave receiver to receive the code sequence in the satellite radio wave;

determining whether there is a match between the expected code sequence and the code sequence of the satellite radio wave;

in response to determining that there is a match, obtaining a first present date and time information represented by the expected code sequence; and correcting the calculated date and time, based on the first present date and time information obtained;

means for, in response to estimating the degree of deviation to be greater than the first predetermined range and equal to or smaller than a second predetermined range, executing a second method among the plurality of methods to correct the calculated date and time, the second method comprising:

controlling the satellite radio wave receiver to receive a first portion of the code sequence;

obtaining a second present date and time information represented by the first portion of the code sequence; and correcting the calculated date and time, based on the second present date and time information obtained; and means for, in response to estimating the degree of deviation to be greater than the second predetermined range and equal to or smaller than a third predetermined range, executing a third method among the plurality of methods to correct the calculated date and time, the third method comprising:

controlling the satellite radio wave receiver to receive a second portion of the code sequence;

obtaining a third present date and time information represented by the second portion of the code sequence, wherein the third present date and time information includes additional information than the second present date and time information; and correcting the calculated date and time, based on the third present date and time information obtained.

17. A method comprising:

determining an elapsed time since a previous correction of a calculated date and time calculated by a time calculating circuit;

estimating a degree of deviation included in the calculated date and time, based on the elapsed time;

in response to estimating the degree of deviation to be equal to or smaller than a first predetermined range, executing a first method among a plurality of methods to correct the calculated date and time, the first method comprising:

generating an expected code sequence of a code sequence in a satellite radio wave to be received from a satellite;

controlling a satellite radio wave receiver to receive the code sequence in the satellite radio wave;

determining whether there is a match between the expected code sequence and the code sequence of the satellite radio wave;

in response to determining that there is a match, obtaining a first present date and time information represented by the expected code sequence; and correcting the calculated date and time, based on the first present date and time information obtained;

in response to estimating the degree of deviation to be greater than the first predetermined range and equal to or smaller than a second predetermined range, executing a second method among the plurality of methods to correct the calculated date and time, the second method comprising:

controlling the satellite radio wave receiver to receive a first portion of the code sequence;

obtaining a second present date and time information represented by the first portion of the code sequence; and correcting the calculated date and time, based on the second present date and time information obtained; and in response to estimating the degree of deviation to be greater than the second predetermined range and equal to or smaller than a third predetermined range, executing a third method among the plurality of methods to correct the calculated date and time, the third method comprising:

controlling the satellite radio wave receiver to receive a second portion of the code sequence;

obtaining a third present date and time information represented by the second portion of the code sequence, wherein the third present date and time information includes additional information than the second present date and time information; and correcting the calculated date and time, based on the third present date and time information obtained.

18. A non-transitory computer-readable storage device storing instructions that cause one or more computers to at least:

determine an elapsed time since a pervious correction of a calculated date and time calculated by a time calculating circuit;

estimate a degree of deviation included in the calculated date and time, based on the elapsed time;

in response to estimating the degree of deviation to be equal to or smaller than a first predetermined range, execute a first method among a plurality of methods to correct the calculated date and time, the first method comprising:

generating an expected code sequence of a code sequence in a satellite radio wave to be received from a satellite;

controlling a satellite radio wave receiver to receive the code sequence in the satellite radio wave;

determining whether there is a match between the expected code sequence and the code sequence of the satellite radio wave;

in response to determining that there is a match, obtaining a first present date and time information represented by the expected code sequence; and correcting the calculated date and time, based on the first present date and time information obtained;

in response to estimating the degree of deviation to be greater than the first predetermined range and equal to or smaller than a second predetermined range, execute a second method among the plurality of methods to correct the calculated date and time, the first method comprising:

controlling the satellite radio wave receiver to receive a first portion of the code sequence;

obtaining a second present date and time information represented by the first portion of the code sequence; and correcting the calculated date and time, based on the second present date and time information obtained; and in response to estimating the degree of deviation to be greater than the second predetermined range and equal to or smaller than a third predetermined range, execute a third method among the plurality of methods to correct the calculated date and time, the third method comprising:

controlling the satellite radio wave receiver to receive a second portion of the code sequence;

obtaining a third present date and time information represented by the second portion of the code sequence, wherein the third present date and time information includes additional information than the second present date and time information; and correcting the calculated date and time, based on the third present date and time information obtained.

* * * * *